US005834892A

United States Patent [19]

Kikuchi et al.

[11] Patent Number: 5,834,892

[45] Date of Patent: Nov. 10, 1998

[54] FLUORESCENT DISPLAY TUBE

[75] Inventors: Yasuyuki Kikuchi; Tatsuya Kurobuchi, both of Mobara, Japan

[73] Assignee: Futaba Denshi Kogyo K.K., Mobara, Japan

[21] Appl. No.: 864,737

[22] Filed: May 28, 1997

[30] Foreign Application Priority Data

Jun. 4, 1996 [JP] Japan ..... 8-141702

[51] Int. Cl.[6] ..... H01J 19/08

[52] U.S. Cl. ..... 313/496; 313/495; 313/497; 313/272; 313/273; 313/279

[58] Field of Search ..... 313/495, 496, 313/497, 272, 273, 279

[56] References Cited

U.S. PATENT DOCUMENTS 4,047,274 9/1977 Kishino et al. ..... 313/497
4,049,993 9/1977 Kishino et al. ..... 313/497
5,179,317 1/1993 Watanabe et al. ..... 313/279
5,424,607 6/1995 Jeong ..... 313/272

*Primary Examiner*—Nimeshkumar Patel
*Attorney, Agent, or Firm*—Oblon, Spivak, McClelland, Maier, & Neustadt, P.C.

[57] ABSTRACT

To obtain a fluorescent display tube which allows the cathode to be driven by a DC current from a battery even when the overall length of the tube becomes large. This object can be achieved by: placing anchors 11A and 11B on both ends of the cathode 10; placing a support on the middle point between the anchors 11A and 11B, to which part of the cathode 10 has been fixed; and adjusting the lengths between the support and the anchors 11A and 11B to be 100 mm or less, and then adding DC power sources 13A and 13B which pass DC currents negative with respect to the support, and positive with respect to the anchors 11A and 11B between the support 12 and the anchors 11A and 11B.

15 Claims, 3 Drawing Sheets

FLUORESCENT DISPLAY TUBE

BACKGROUND OF THE INVENTION

1. Field of the Invention

This invention relates to a fluorescent display tube which contains, in an evacuated enclosure, a filamentous cathode and an anode to which a fluorescent material has been applied, particularly to a fluorescent display tube in which the cathode is activated by a DC source.

2. Description of the Related Art

The fluorescent display tube is generally produced after an anode and a fluorescent layer have been placed one over the other on an anode substrate, a control electrode placed above them with a specific distance, a filamentous cathode placed with a specific distance further above the control electrode, and these elements placed in an evacuated enclosure which is formed after the anode substrate and a glass panel have been sealed.

When, in the fluorescent display tube with above constitution, an electric current is passed through the cathode to heat it, thermionic emission of electrons will result. In this state, when positive voltages are applied to the anode and control electrode, electrons emitted from the cathode are accelerated by the anode and control electrode, and strike against the anode to excite the fluorescent material there. By this operation, a desired display can be obtained.

In this type of fluorescent display tube, as shown in the circuit diagram of FIG. 6, when the cathode is driven by a voltage from the DC source 21, one end of the cathode 20 (on the left side in the figure) is grounded to act as the reference for the voltages of the anode 22 and control electrode 23. Thus, the voltage developing in the directly heated cathode 20 has a gradient in the long axis, which causes a difference between the voltages of the anode 22 with respect to the cathode 20 and the corresponding voltage of the control electrode 23, to have a gradient in the long axis. This, in turn, causes a gradient in the brightness of spots along the long axis. To solve this problem, the cathode is hung so obliquely to the anode substrate that the gradient of voltage along the long axis can be canceled out, thereby to make even the brightness of spots along the long axis.

If a fluorescent display tube has a too large length, L or the difference in distance from the cathode 20 to the control electrode 23 between left and right ends has to become large to cancel out the difference in voltage developed between the two ends. If L becomes large, the cathode 20 will also have a big resistance and the gradient in voltage, if not corrected, will become large. Thus, to cancel out this enlarged potential gradient, it will be necessary to elongate further L or the difference in distance from the cathode 20 to the control electrode 23 between left and right ends.

To prepare a display tube having a large length, L or the distance difference of the cathode 20 from the control electrode 23 between left and right ends must be elongated too. Then, L is restricted not only by the height of the enclosure, but also by the possibility that the cathode 20 may come into contact with the control electrode 23 as a result of vibrations associated with emission of electrons because at this state the cathode will be too close to the control electrode.

As seen from above, generally, when a fluorescent display tube has a large length, and the cathode is driven by a DC source, a voltage applied to the positive end of anode 22 and control electrode 23 is reduced substantially by the voltage applied to the negative side. Accordingly, when the cathode is driven by a voltage from the DC source 21 or a battery, the resulting fluorescent display tube has a limitation in length, which is about 100 mm.

Further, when the display tube has a large length, to balance the brightness between left and right ends, it is necessary to correct L or the distance between the cathode 20 and the control electrode 23 at the positive side of the DC source 21. When the cathode 20 is driven by a DC source such as a battery, it is impossible to elongate the display tube beyond a certain length, because then the reliable operation of the tube would be impaired. To put it more explicitly, when the tube is allowed to have a length of 100 mm, the acceptable minimal distance between the cathode 20 and control electrode 23 will be 0.4 mm. If the distance were smaller than this, the cathode might come into contact with the control electrode, as mentioned earlier, as a result of vibrations associated with emission of electrons which would make it impossible to get a desired display.

To meet the above problem, a method is proposed in which two display tubes each having a length of 100 mm are placed side by side, to increase an effective length. In this arrangement, however, each of the display tubes has its own unevenness in brightness, and hence the whole consisting of the two does not present a balanced brightness. Further, as the two separate tubes are arranged side by side so that their displays merge into one, the balance may be impaired depending on how they are placed relative to each other.

Accordingly, generally speaking, for tubes having a length of 100 mm or more, it is necessary to use an AC source for driving the cathode 20. Take as an example a case where it is necessary to install a fluorescent display tube with a length of 100 mm or more into a car. Conventionally, a DC current from a 12V battery in the car is fed to a DC-AC converter to produce an AC current which is used to activate the tube.

When the system incorporating the use of a DC-AC converter is employed, not only the system will require a higher cost, but it will be accompanied with a larger noise because of the converter being driven by pulses, and thus will not allow a stable presentation of displays.

SUMMARY OF THE INVENTION

This invention has been proposed as a remedy for the problems described above, and intends to provide a fluorescent display tube whose cathode can be driven by a DC source such as a battery, even if it has a large length.

To attain the above object, the invention provides a fluorescent display tube 1 which comprises: a filamentous cathode 10 which emits electrons when heated by a DC current; and an anode 6 to which is applied a fluorescent body which generates light when excited through bombardment of the electrons emitted thermionically, contained within an evacuated enclosure 2, and which is characterized by further comprising: anchors 11 (11A and 11B) at both ends of the cathode; and DC sources 13 (13A and 13B) which apply negative DC signals to the support 12, and positive DC signals to both of the anchors.

The invention further is directed to a fluorescent display tube wherein the positions at which the cathode 10 is attached to the anchors 11A and 11B are the same in height.

The invention further is directed to a fluorescent display tube wherein the support 12 is placed at the middle point between the anchors 11, and the DC sources 13 are so arranged as to give voltages the same in intensity to both ends of the anchors.

The invention further is directed to a fluorescent display tube wherein the support 12 is displaced from the middle point towards one of the anchors 11, and the DC sources are so arranged as to give DC signals different in intensity to the left and right anchors 11.

The invention is further directed to a fluorescent display tube wherein the anchors 11A and 11B are allowed to be different in height in their attachment to the cathode 10.

The invention is further directed to a fluorescent display tube wherein the core filament of the cathode 10 is made of an alloy of Re—W.

The invention is further directed to a fluorescent display tube wherein the cathode portion between the anchor 11 and the support 12 has a length of 100 mm or less.

The fluorescent display tube of this invention has anchors 11A and 11B on both ends of the cathode 10. At the middle point between the anchors 11A and 11B, or at a point close to the middle point is placed a support 12 to which part of the cathode 10 has been fixed. The length of cathode 10 spanning between the anchor 11A and the support 12 and between the support 12 and the anchor 11B is 100 mm or less. To the support 12 and anchors 11A and 11B are connected DC sources 13A and 13B in such a way that negative DC signals are applied to the support 12, and positive DC signals are applied to both anchors 11A and 11B. Through this arrangement, it is possible to produce a fluorescent display tube having a length of 100 mm or more whose cathode is driven by a DC current.

DETAILED DESCRIPTION OF THE PREFERRED EMBODIMENT

Figure 1:
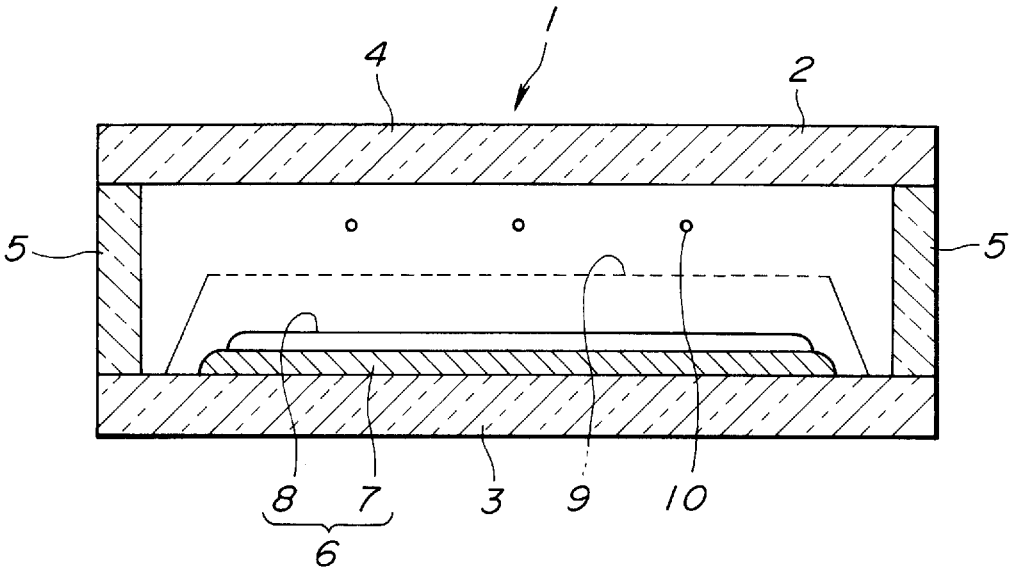
FIG. 1 shows sectional view of the fluorescent display tube illustrating its structure schematically.
Figure 2:
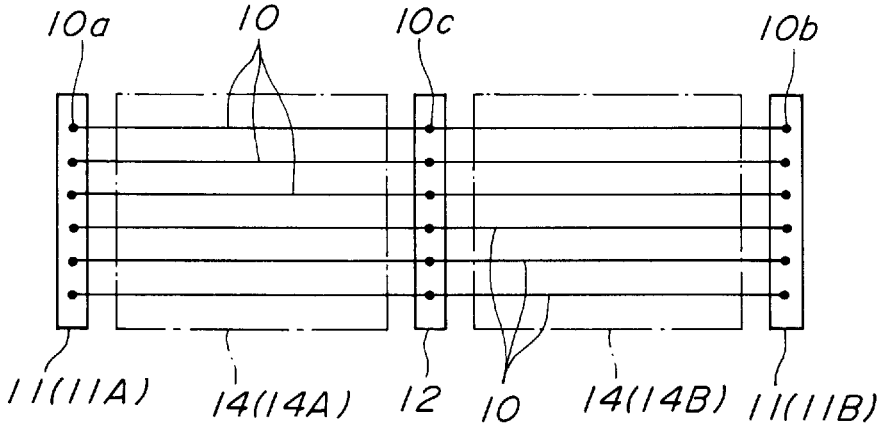
FIG. 2 represents Example 1 of this invention, and gives a flat view of the cathode illustrating its constitution schematically.
Figure 3:
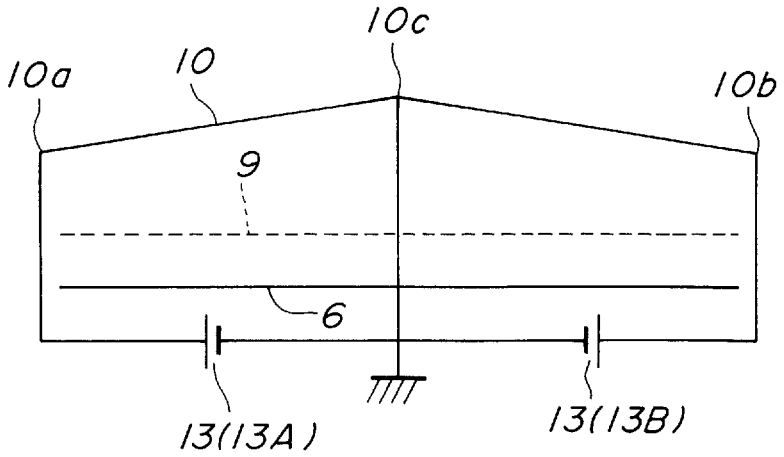
FIG. 3 shows a simplified circuit diagram of the power sources for the cathode of the fluorescent display tube whose constitution is represented in FIG. 2.

FIG. 1 gives a cross-section for illustrating the outline of the fluorescent display tube, FIG. 2 gives the first embodiment of this invention applied as a fluorescent display tube, and shows a schematic flat view of the constitution of the cathode, and FIG. 3 gives a circuit diagram of the cathode of the fluorescent display tube with special reference to the power source. The power sources of the anode and control electrode, and a cut-off bias which blocks leakage of light are omitted from FIG. 3.

As shown in FIG. 1, the fluorescent display tube 1 has an enclosure 2 whose interior has been kept at a highly evacuated state, and into the interior of the enclosure 2 are installed various electrodes and elements including a phosphor display. The enclosure 2 of the fluorescent display tube 1 shown in FIG. 1 is constituted with insulating plates made of glass or the like appropriately combined, wherein an anode substrate 3 and a light-transmissive frontal substrate 4 have been allowed to face to each other with a specific interval, side panels 5 combined to form a frame are inserted between the outer rims of the two substrates 3 and 4, and these plate members are bonded together.

On the inner surface of the anode substrate 3 is placed an anode 6 which acts as a phosphor display. The anode 6 consists of an anode conductor 7 having a specific pattern and connected to a conductor not illustrated here, and a fluorescent layer 8 applied onto the anode conductor 7. The anode 6, when given a positive voltage (for example a DC voltage of +12V as by the battery installed in a car), receives the bombardment of electrons accelerated/dispersed by a control electrode 9 described later and, and allows the fluorescent body in the fluorescent layer 8 to be sufficiently excited to generate light.

Above the anode 6, the control electrode 9 is mounted such that it will not interfere with the display. The control electrode 9 is produced after a thin plate made of stainless steel has been processed by photo-etching into a mesh structure. When the control electrode 9 receives a positive voltage (for example a DC voltage of +12V as by the battery in a car), it accelerates/disperses electrons emitted from a cathode 10 described later, to guide them towards the anode 6. When the control electrode does not receive a positive voltage, it blocks the passage of electrons heading towards the anode, to abolish the display.

Above the control electrode is placed a filamentous cathode 10 or a source of electrons in such a manner as not to interfere with the display. The cathode 10 is hung between left anchor and a support, and between the support and right anchor. The anchors 11 are movable members made of a springy material, and are stretched with an appropriate tension, while the support 12 is fixed in position. This constitution prevents the cathode from becoming elongated to be slack by thermal expansion.

To put it more in detail, the cathode 10, as shown in FIG. 2, has one end 10*a* and the other end 10*b* fixed onto the anchors 11A and 11B, respectively. The middle point 10*c* along the long axis is fixed, for example by welding, to the support 12. For the cathode 10, the distances between one end 10*a* and the middle point 10*c*, and between the other end 10*b* and the middle point 10*c* are each determined to be 100 mm or less.

The positions at which the cathode is attached to the left and right anchors 11A and 11B are lower than the corresponding position at which the cathode is attached to the middle point 10*c*, and have the same height each other. Thus, the cathode 10 is hung between the middle point 10*c* of the support 12 and the left and right anchors 11A and 11B with downward gradients bilaterally.

The fluorescent display tube 1 has two patterns 14 left and right (14A and 14B) with the middle points 10*c* of the cathode 10 fixed onto the support 12 as the boundary, in the spaces between the middle points 10*c* and the left and right anchors 11A and 11B. When the system is utilized, for example, as a fluorescent display tube mounted onto the dashboard of a car, one pattern can be used for the display of an odometer and the other for the display of an trip meter. Of course, the display of odometer and trip meter can be exchanged with the same profit for the display of an speed meter, fuel indicator, or the like.

As shown in FIG. 3, between the support 12 to which the middle points 10*c* of the cathode 10 have been fixed, and the left anchor 11A to which the left ends 10*a* of the cathode 10 have been attached is placed a first DC source 13A (13) which acts as a driving source to expel electrons by heating from the left pattern 14A. On the other hand, between the support 12 to which the middle points 10*c* of the cathode 10 have been fixed, and the right anchor 11B to which the right ends of the cathode 10 have been attached is placed a second DC source 13B (13) which acts as a driving source to expel electrons by heating from the right pattern 14B.

These DC sources 13A and 13B can be obtained, when the fluorescent display tube 1 is installed in a car, after the DC voltage of 12v of the battery has been converted through a transformer not illustrated here and composed simply of transistors, resistors, and diodes to appropriate DC voltages such as 1.2–3 V. The anode 6 and the control electrode are supplied with a DC voltage of a specified level, or, for example, a DC voltage of 12v from the battery in the car.

The DC power sources 13 have their positive ends connected to the anchors 11A and 11B, while the DC sources 13 have their negative ends connected to the support 12 and the connection is grounded.

Through this connection, the middle points 10*c* of the cathode which have been fixed to the support 12 are grounded to act as a reference for the potentials developed at the anode 6 and the control electrode 9. Then, to the left ends of the cathode 10 fixed onto the anchor 11A, is applied a positive DC voltage from the first DC source 13A, while to the right ends of the cathode 10 fixed onto the anchor 10*c* is applied a positive DC voltage from the second DC source 13B. On the contrary, to the support 12 to which the middle points 10*c* of the cathode 10 have been fixed are applied negative DC voltages from the DC sources 13.

In this fluorescent display tube 1, as described above, when a current is passed through the cathode 10 from the DC sources 13, thermionic emission of electrons occurs at the cathode 10. At this state, positive voltages such as 12v from the battery of a car are applied to a segment of the anode 6 which will give a desired display, and to a desired place of the control electrode 9. Through this operation, electrons emitted from the cathode 10 are accelerated under the influence of an electric field developed between the anode 6 and control electrode 9, and the cathode 10. The accelerated electrons, after passing through the control electrode 9, strike against the anode 6, to excite a fluorescent body in a fluorescent layer there to give rise to light. Through this sequence of events, a desired display is realized, and the phosphor display on the anode 6 can be seen through a front substrate 4 by a spectator outside an enclosure 2.

As seen from above, in the fluorescent display tube of Example 1, the support 12 placed between the anchors 11A and 11B is connected to one end of the DC sources 13A and 13B, and the left and right sides of the cathode 10 are separately connected to the first and second DC sources 13A and 13B, respectively with the middle points 10*c* of the cathode 10 fixed to the support 12 as a boundary. Thus, to achieve the same effect as in Example 1, it is not always necessary for the fixing point of the cathode 10 to fall upon the middle points 10*c*.

Figure 4:
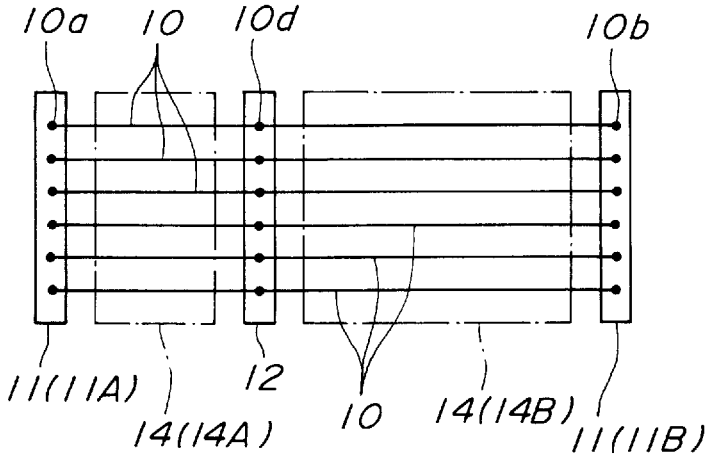
FIG. 4 represents Example 2 of this invention, and gives a flat view of the cathode illustrating its constitution schematically.
Figure 5:
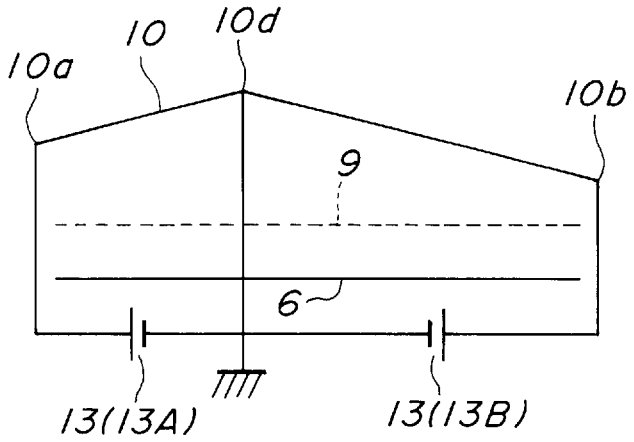
FIG. 5 shows a simplified circuit diagram of the power sources for the cathode of the fluorescent display tube whose constitution is represented in FIG. 4.
Figure 6:
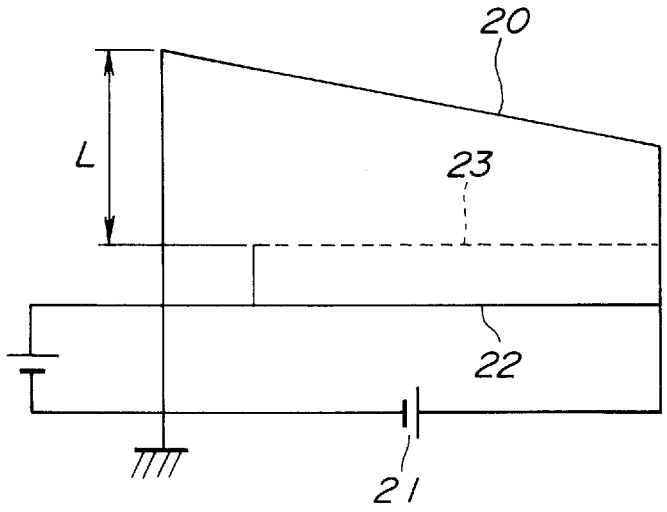
FIG. 6 shows a simplified circuit diagram of the conventional fluorescent display tube and illustrates how a DC current is applied to produce a voltage in the cathode.

FIG. 4 shows the constitution of Example 2 of this invention, and gives a flat view of how the cathode 10 is fixed to a position shifted from the middle points 10*c*. FIG. 5 gives a circuit diagram with regard to the power source of the cathode when the fluorescent display tube has the constitution as shown in FIG. 4. The power source to the anode and control electrode, and a cut-off bias to prevent against leakage of light are omitted from FIG. 5.

In Example 2, in contrast with Example 1 where the middle points 10*c* of the cathode 10 are fixed to the support, the fixed position of the cathode 10 between the left and right anchors 11A and 11B is shifted towards left from the middle point 10*c*. Namely, the cathode 10 between the support 12 and the left anchor 11A has a larger length than does the counterpart between the support 12 and the right anchor 11B. In this case, the distances between the support and the left anchors 11A and 11B are each equal to or less than 100 mm.

Further, to keep a balance in brightness between left and right sides, the positions 10*d* at which the cathode is fixed to the support 12 are allowed to have different heights with respect to the left and right anchors 11A and 11B to which the cathode is also fixed. In the example depicted in FIG. 4, the left anchor 11A is allowed to have a larger height than does the right anchor 11B.

The fluorescent display tube 1 comprises two patterns 14 one on the left (14A) and the other on the right (14B) with the fixation points 10*d* of the cathode 10 being as a boundary.

In this constitution, the lengths of the cathode from the support 12 to the anchors 11A and 11B are different from each other, and hence, the first and second DC sources have different voltages. To the anchor 11A is applied a positive voltage from the first DC source 13A. At the same time, to the anchor 11B is applied a positive voltage from the second DC source 13B.

Then, the left and right patterns are separately activated by the first and second DC sources respectively, and thus the brightness belonging to the left and right patterns can be maintained constant.

In the above-described example, the cathode is fixed at a position between the anchors 11A and 11B. This is the position at which the support 12 is placed, and from which display is eliminated. Further, when the cathode 10 is heated, heat will escape from both ends of the cathode 10 towards the anchors 11 and support 12, which necessitates the installment of redundant ends.

The redundant ends here concerned refer to both ends of the cathode 10 which will become too low in temperature to emit electrons as a result of heat escaping from there towards the anchors 11 and support 12 which act as a support of the cathode 10.

The cathode 10, as has already been described by the present applicants in the Japanese Unexamined Patent Publication No. 6-223748, takes the form of a linear filament made of an alloy of W which contains 7–26 wt. % of Re, and which is coated with an oxide or a compound acting as an emitter of electrons. The cathode of this constitution makes it possible for the redundant ends to be reduced: the pattern area from which display is eliminated is reduced down to 8 mm, although conventionally, the redundant ends require a total length of about 16 mm.

The fluorescent display tubes according to above examples will bring about following effects.

The ends 10*a* and 10*b* of the cathode 10 are attached to the anchors 11A and 11B which are movable, and the middle points 10*c* of the cathode 10 or points close to the middle points 10*c* are fixed to the support which are immobilized. This constitution allows the fluorescent display tube corresponding in function with two conventional fluorescent display tubes to be contained in an enclosure, and thus the fluorescent display tube to have an effective length of 100 mm or longer.

Overall, the left and right patterns 14A and 14B can be separately driven by the first and second DC sources 13A and 13B, and thus the brightness of the patterns 14A and 14B can be maintained constant.

As the middle points of the cathode 10 or points close to them are continuously connected and fixed onto the support 12, vibrations resulting from excitation of the cathode 10 while being driven by the source can be more or less reduced. This arrangement requires less welding and only one support, which will results in the reduction of necessary parts.

As compared with the conventional system which comprises two fluorescent display tubes, the present tube comprising two patterns left and right 14A and 14B allows the displays on both sides to be more balanced and equalized.

As compared with the conventional system which comprises two fluorescent display tubes, the present tube incorporates only one support in place of a side panel at the mid-section, and thus allows the mid-section to have a relatively wide area, and further parts necessary for the composition of the fluorescent display tube to be assembled by a single sequence of steps.

As compared with the conventional system which comprises two fluorescent display tubes, the present tube allows the enclosure to be reduced in size and the parts to be assembled at a higher density.

As this system dispenses with the use of a DC-AC converter as is the case with the conventional system, it can lower the cost for the production. It can be produced at a lower cost than the conventional one incorporating two fluorescent display tubes.

As this uses an alloy of Re—W as a core filament of the cathode 10, it allows the redundant ends to be reduced in length, and the difference between the left and right patterns to be minimized.

In above examples, the anode 6 and control electrode 9 in the patterns 14A and 14B can be driven by any methods including a dynamic driving or a static driving and is not limited to any specific driving methods. For example, even when both the patterns 14A and 14B are driven dynamically, or when the patterns 14A and 14B are driven statistically and dynamically respectively, the anode 6 and control electrode 9 can be driven in an optimal way according to the circumstances where the given system is used.

In the fluorescent display tubes in above examples, description has been given with reference to figures on the assumption that the phosphor display on the anode is viewed through the front substrate 4. But this invention can also be applied to the so-called front phosphor type of fluorescent display tube where the anode conductor 7 is allowed to be light-transmissive, and the fluorescence from the fluorescent layer 8 is viewed through the anode conductor 7 and anode substrate 3. In addition, the fluorescent display tube to which this invention can be applied is not restricted by the presence or the number of control electrodes: for example, it can have two or more control electrodes.

As is evident from above description, according to this invention, both ends of a cathode are attached to anchors which are movable, and a support is fixed at the middle point, or at a point close to the middle point between the both ends of the cathode. This constitution allows the resulting fluorescent display tube to contain elements corresponding with two conventional display tubes in one enclosure, and thereby to have a large length.

Overall, the left and right patterns 14A and 14B can be separately driven by DC sources, and thus the brightness of the patterns can be maintained constant. In addition, the core filament of the cathode is made of an alloy of Re—W which further contributes to the equalization of the brightness between the left and right patterns.

As the middle points or points close to the middle points of the cathode are fitted continuously to the support, necessary parts are reduced in number, and vibrations of the cathode during activation by DC sources can be suppressed.

When this system is compared with a conventional fluorescent display tube incorporating two units, it is more excellent in giving a balanced display between the left and right patterns, allows the display to have a wider area, and parts to be assembled by a single sequence of steps. In addition, as this system dispenses with a DC-AC converter in contrast with conventional systems, it will reduce a cost involved in the construction of the production system.

What is claimed is:

1. A fluorescent display tube containing, in an evacuated enclosure, a filamentous cathode which emits electrons when thermally excited by a DC current, and an anode to which a fluorescent material has been applied which emits light when struck with the electrons thermally excited, in which to both ends of the cathode are attached anchors, and between the anchors is placed a support to which part of the cathode is fixed, is characterized by having DC sources which apply negative DC signals to the support, and positive DC signals to both of the anchors.

2. A fluorescent display tube as described in claim 1 in which the cathode is attached to both of the anchors at the same height.

3. A fluorescent display tube as described in claim 2 in which an alloy of Re—W is used as a core filament of the cathode.

4. A fluorescent display tube as described in claim 2 in which the cathode fraction between the anchor and support has a length of 100 mm or less.

5. A fluorescent display tube as described in claim 1 or 2 in which the support is placed at the middle point between the anchors, and the DC source applies DC signals of the same level to both of the anchors.

6. A fluorescent display tube as described in claim 5 in which an alloy of Re—W is used as a core filament of the cathode.

7. A fluorescent display tube as described in claim 5 in which the cathode fraction between the anchor and support has a length of 100 mm or less.

8. A fluorescent display tube as described in claim 1 in which the support is shifted more towards one anchor from the middle point between the anchors, and the DC sources apply DC signals different in level to both of the anchors.

9. A fluorescent display tube as described in claim 8 in which an alloy of Re—W is used as a core filament of the cathode.

10. A fluorescent display tube as described in claim 8 in which the cathode fraction between the anchor and support has a length of 100 mm or less.

11. A fluorescent display tube as described in claim 1 in which the cathode has been attached to both of the anchors at different heights.

12. A fluorescent display tube as described in claim 11 in which an alloy of Re—W is used as a core filament of the cathode.

13. A fluorescent display tube as described in claim 11 in which the cathode fraction between the anchor and support has a length of 100 mm or less.

14. A fluorescent display tube as described in claim 1 in which an alloy of Re—W is used as a core filament of the cathode.

15. A fluorescent display tube as described in claim 1 in which the cathode fraction between the anchor and support has a length of 100 mm or less.

* * * * *